US011783770B2

(12) United States Patent
Kim et al.

(10) Patent No.: US 11,783,770 B2
(45) Date of Patent: Oct. 10, 2023

(54) DISPLAY DEVICE

(71) Applicant: LG Display Co., Ltd., Seoul (KR)

(72) Inventors: Jae Yoon Kim, Seoul (KR); Minjae Yoo, Seoul (KR); Wangun Lee, Seoul (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/966,219

(22) Filed: Oct. 14, 2022

(65) Prior Publication Data

US 2023/0169915 A1 Jun. 1, 2023

(30) Foreign Application Priority Data

Nov. 29, 2021 (KR) ..... 10-2021-0166587

(51) Int. Cl.
*G09G 3/3208* (2016.01)

(52) U.S. Cl.
CPC ... *G09G 3/3208* (2013.01); *G09G 2310/0232* (2013.01); *G09G 2320/0247* (2013.01); *G09G 2320/0257* (2013.01); *G09G 2320/0626* (2013.01)

(58) Field of Classification Search
CPC ..... G09G 3/3208; G09G 2310/0232; G09G 2320/0247; G09G 2320/0257; G09G 2320/062
USPC ..... 345/690
See application file for complete search history.

(56) References Cited

U.S. PATENT DOCUMENTS

2004/0201549 A1* 10/2004 Weitbruch ..... H04N 7/0122 348/556
2006/0132653 A1* 6/2006 Higashi ..... H04N 7/0122 348/556
2007/0024531 A1* 2/2007 Higashi ..... G09G 3/20 345/60
2022/0044416 A1* 2/2022 Ji ..... G06T 7/20

FOREIGN PATENT DOCUMENTS

KR 10-2004-0082291 A 9/2004

* cited by examiner

*Primary Examiner* — Amare Mengistu
*Assistant Examiner* — Gloryvid Figueroa-Gibson
(74) *Attorney, Agent, or Firm* — Morgan, Lewis & Bockius LLP

(57) ABSTRACT

A display device includes a display panel which includes a letterbox area and an image display area which displays an image and includes a boundary luminance variable area extending from the letterbox area; and a luminance control unit which controls a reduced luminance amount of the boundary luminance variable area based on the image.

14 Claims, 11 Drawing Sheets

DISPLAY DEVICE

CROSS-REFERENCE TO RELATED APPLICATIONS

This application claims the priority of Korean Patent Application No. 10-2021-0166587 filed on Nov. 29, 2021, in the Korean Intellectual Property Office, the disclosure of which is incorporated herein by reference.

BACKGROUND

Technical Field

The present disclosure relates to a display device, and more particularly, to a display device which controls a luminance in a region adjacent to a letterbox to reduce an afterimage.

Discussion of the Related Art

As display devices which are used for a monitor of a computer, a television, or a cellular phone, there are an organic light emitting display (OLED) device which is a self-emitting device and a liquid crystal display (LCD) device which requires a separate light source.

An applicable range of the display device is diversified to personal digital assistants as well as monitors of computers and televisions, and a display device with a large display area and a reduced volume and weight is being studied.

In the meantime, recently, a display device and an image configured with various screen ratios are being manufactured. However, as a screen ratio of the image and a ratio of the display device are diversified, in some cases, the ratios of the image and the display device do not match. Accordingly, a letterbox which is a black bar generated on the top or bottom, or left or right of the screen is used during a process of modifying the image to be fitted to the display device while maintaining an existing ratio.

SUMMARY

Accordingly, embodiments of the present disclosure are directed to a display device that substantially obviates one or more of the problems due to limitations and disadvantages of the related art.

An aspect of the present disclosure is to provide a display device which reduces a luminance in a surrounding area of a letterbox to reduce an afterimage.

Another aspect of the present disclosure is to provide a display device in which a luminance reduction rate in the surrounding area of the letterbox varies depending on a characteristic of an image to be displayed.

Still another aspect of the present disclosure is to provide a display device which gradually reduces a luminance of an area adjacent to a letterbox to minimize the visual recognition of the luminance reduced area.

Additional features and aspects will be set forth in the description that follows, and in part will be apparent from the description, or may be learned by practice of the inventive concepts provided herein. Other features and aspects of the inventive concepts may be realized and attained by the structure particularly pointed out in the written description, or derivable therefrom, and the claims hereof as well as the appended drawings.

To achieve these and other aspects of the inventive concepts, as embodied and broadly described herein, a display device comprises a display panel which includes a letterbox area and an image display area which displays an image and includes a boundary luminance variable area extending from the letterbox area; and a luminance control unit which controls a reduced luminance amount of the boundary luminance variable area based on the image.

In another aspect, a display device comprises a display panel in which a letterbox area and an image display area which is disposed at one side of the letterbox area and displays an image are defined; and a luminance control unit which analyzes an image to reduce a luminance of a boundary luminance variable area of the image display area adjacent to the letterbox area, and when a dynamic image, between a static image and a dynamic image, is displayed, the luminance control unit reduces a luminance of the boundary luminance variable area more.

Other detailed matters of the exemplary embodiments are included in the detailed description and the drawings.

According to the present disclosure, an afterimage deviation between a letterbox area and an image display area can be reduced.

According to the present disclosure, the luminance of the surrounding area of the letterbox is differently reduced according to a characteristic of an image to be displayed to minimize the visual recognition of the reduction in the luminance.

According to the present disclosure, a luminance of a part of an image display area adjacent to a letterbox area is gradually reduced to minimize the visual recognition of the luminance reduction like a bar.

It is to be understood that both the foregoing general description and the following detailed description are exemplary and explanatory and are intended to provide further explanation of the inventive concepts as claimed.

BRIEF DESCRIPTION OF THE DRAWINGS

The accompanying drawings, which are included to provide a further understanding of the disclosure and are incorporated in and constitute a part of this application, illustrate embodiments of the disclosure and together with the description serve to explain various principles. In the drawings.

DETAILED DESCRIPTION

Figure 1:
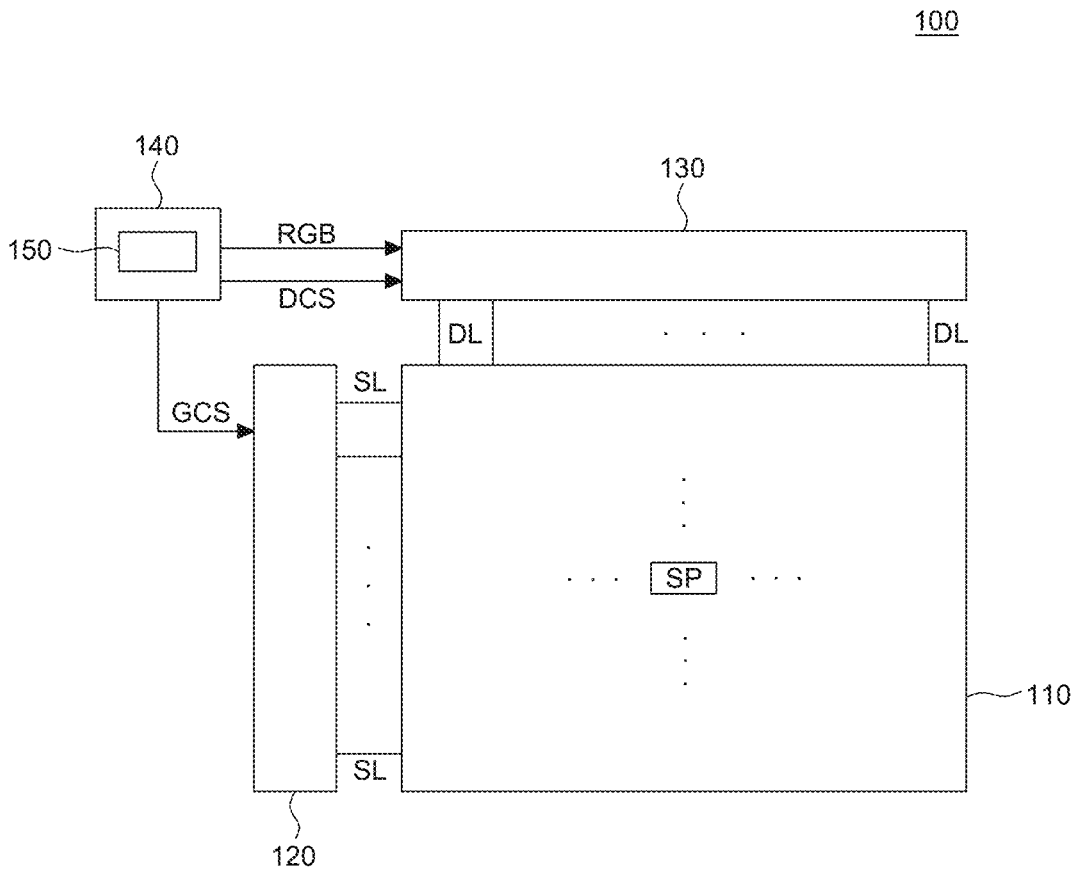
FIG. 1 is a schematic diagram of a display device according to an exemplary embodiment of the present disclosure.

Advantages and characteristics of the present disclosure and a method of achieving the advantages and characteristics will be clear by referring to exemplary embodiments described below in detail together with the accompanying drawings. However, the present disclosure is not limited to the exemplary embodiments disclosed herein but will be implemented in various forms. The exemplary embodiments are provided by way of example only so that those skilled in the art can fully understand the disclosures of the present disclosure and the scope of the present disclosure. Therefore, the present disclosure will be defined only by the scope of the appended claims.

The shapes, sizes, ratios, angles, numbers, and the like illustrated in the accompanying drawings for describing the exemplary embodiments of the present disclosure are merely examples, and the present disclosure is not limited thereto. Like reference numerals generally denote like elements throughout the specification. Further, in the following description of the present disclosure, a detailed explanation of known related technologies may be omitted to avoid unnecessarily obscuring the subject matter of the present disclosure. The terms such as "including," "having," and "consist of" used herein are generally intended to allow other components to be added unless the terms are used with the term "only". Any references to singular may include plural unless expressly stated otherwise.

Components are interpreted to include an ordinary error range even if not expressly stated.

When the position relation between two parts is described using the terms such as "on", "above", "below", and "next", one or more parts may be positioned between the two parts unless the terms are used with the term "immediately" or "directly".

When an element or layer is disposed "on" another element or layer, another layer or another element may be interposed directly on the other element or therebetween.

Although the terms "first", "second", and the like are used for describing various components, these components are not confined by these terms. These terms are merely used for distinguishing one component from the other components. Therefore, a first component to be mentioned below may be a second component in a technical concept of the present disclosure.

Like reference numerals generally denote like elements throughout the specification.

A size and a thickness of each component illustrated in the drawing are illustrated for convenience of description, and the present disclosure is not limited to the size and the thickness of the component illustrated.

The features of various embodiments of the present disclosure can be partially or entirely adhered to or combined with each other and can be interlocked and operated in technically various ways, and the embodiments can be carried out independently of or in association with each other.

Hereinafter, a display device according to exemplary embodiments of the present disclosure will be described in detail with reference to accompanying drawings.

FIG. 1 is a schematic diagram of a display device according to an exemplary embodiment of the present disclosure. In FIG. 1, for the convenience of description, among various components of the display device 100, a display panel 110, a gate driver 120, a data driver 130, a luminance control unit 150, and a timing controller 140 are included.

Referring to FIG. 1, the display device 100 includes a display panel 110 including a plurality of sub pixels SP, a gate driver 120 and a data driver 130 which supply various signals to the display panel 110, a timing controller 140 which controls the gate driver 120 and the data driver 130, and a luminance control unit 150 which controls a luminance of the display panel 110.

The gate driver 120 supplies a plurality of scan signals to a plurality of scan lines SL in accordance with a plurality of gate control signals GCS supplied from the timing controller 140. Even though in FIG. 1, it is illustrated that one gate driver 120 is disposed to be spaced apart from one side of the display panel 110, the number of the gate drivers 120 and the placement thereof are not limited thereto.

The data driver 130 converts image data RGB input from the timing controller 140 into a data voltage using a reference gamma voltage in accordance with a plurality of data control signals DCS supplied from the timing controller 140. The data driver 130 may supply the converted data voltage to a plurality of data lines DL.

The timing controller 140 aligns image data RGB input from the outside to supply the aligned image data RGB to the data driver 130. The timing controller 140 may generate a gate control signal GCS and a data control signal DCS using synchronization signals input from the outside, such as a dot clock signal, a data enable signal, and horizontal/vertical synchronization signals. The timing controller 140 supplies the generated gate control signal GCS and data control signal DCS to the gate driver 120 and the data driver 130, respectively, to control the gate driver 120 and the data driver 130.

The luminance control unit 150 controls a luminance of a boundary luminance variable area adjacent to a letterbox area, in the area of the display panel 110. The luminance control unit 150 analyzes an image to be displayed in the boundary luminance variable area of the display panel 110 and controls the luminance of the boundary luminance variable area based on a characteristic of the image. When the image to be displayed in the boundary luminance variable area is a dynamic or complex image, the amount of reduced luminance of the boundary luminance variable area is increased by the luminance control unit 150. When the image to be displayed in the boundary luminance variable area is a static or simple image, the amount of reduced luminance of the boundary luminance variable area is reduced by the luminance control unit 150. The luminance control unit 150 will be described below in more detail with reference to FIGS. 3 to 9B.

The display panel 110 is a configuration which displays images to the user and includes a plurality of sub pixels SP. In the display panel 110, a plurality of scan lines SL and a plurality of data lines DL intersect each other and the plurality of sub pixels SP is connected to the scan lines SL and the data lines DL, respectively. Even though not illustrated in the drawings, each of the plurality of sub pixels SP may be connected to a high potential power line, a low potential power line, an initialization signal line, and an emission control signal line.

A plurality of sub pixels SP is a minimum unit which configures a screen and each of the plurality of sub pixels SP may include a light emitting diode and a driving circuit for driving the light emitting diode. A plurality of light emitting diodes may be defined in different manners depending on the type of the display panel 110. For example, when the display panel 110 is an organic light emitting display panel, the light emitting diode may be an organic light emitting diode which includes an anode, an organic layer, and a cathode. In addition to this, as a light emitting diode, a quantum-dot light emitting diode (QLED) including quantum dots (QD) may be further used.

Hereinafter, the display panel 110 and the luminance control unit 150 will be described in more detail with reference to FIGS. 2 and 3.

Figure 2:
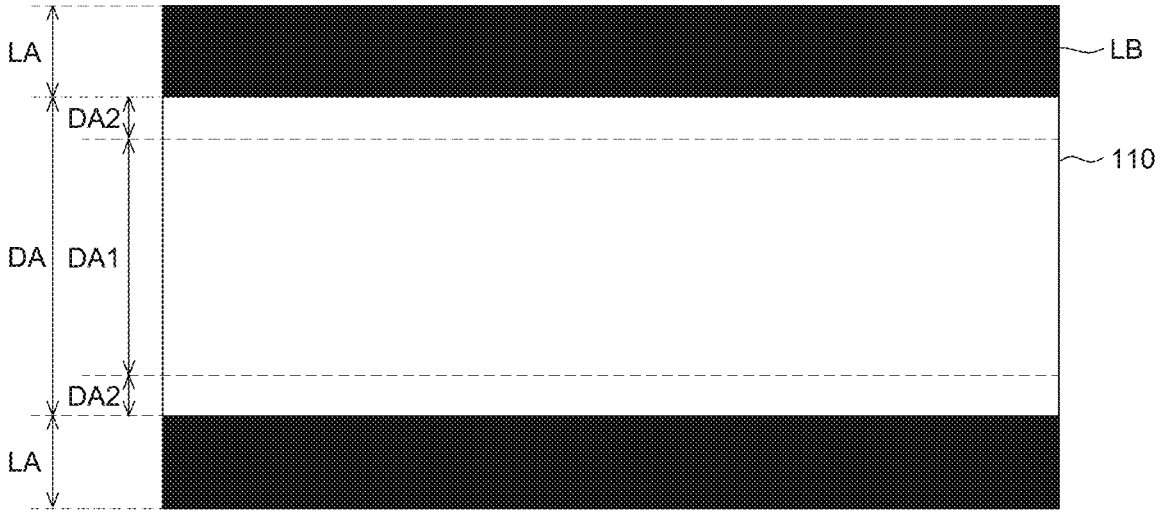
FIG. 2 is a plan view of a display panel of a display device according to an exemplary embodiment of the present disclosure.

FIG. 2 is a plan view of a display panel of a display device according to an exemplary embodiment of the present disclosure. FIG. 3 is a diagram of a luminance control unit of a display device according to an exemplary embodiment of the present disclosure.

Referring to FIG. 2, the display panel 110 includes a letterbox area LA in which a letterbox LB is displayed and an image display area DA including a boundary luminance variable area DA2.

The letterbox area LA is an area in which when ratios of the display panel 110 and the image do not match, an empty space generated on the top, bottom, left, and right of the image, that is, a letterbox LB having a black bar shape is displayed to maintain an image at an existing ratio. The letterbox area LA is an area in which the image is not displayed so that the light emitting diode of the sub pixel SP disposed in the letterbox area LA does not emit light. For example, when a ratio of the display panel 110 is 4:3 and a ratio of the image is 16:9, the letterbox LB displayed with black is added on the top and the bottom of the image so that the image may be displayed on the display panel 110 with a ratio of 4:3 without having a cut portion.

The image display area DA is an area where images are displayed. The image display area DA is a remaining area excluding the letterbox area LA and is formed with the same ratio as a ratio of the image by the letterbox area LA.

The image display area DA includes a boundary luminance non-variable area DA1 and the boundary luminance variable area DA2.

The boundary luminance non-variable area DA1 is an area of the image display area DA excluding the boundary luminance variable area DA2. The boundary luminance non-variable area DA1 is spaced apart from the letterbox area LA by the boundary luminance variable area DA2. The boundary luminance non-variable area DA1 is spaced apart from the letterbox area LA so that it is difficult to visually recognize an afterimage deviation from the letterbox area LA. Further, in the boundary luminance non-variable area DA1, most of the image is displayed so that when the luminance is reduced in the boundary luminance non-variable area DA1, the display quality may be deteriorated. Accordingly, in the boundary luminance non-variable area DA1 which occupies most of the image display area DA, the image may be normally displayed.

The boundary luminance variable area DA2 is an area of the image display area DA adjacent to the letterbox area LA. The boundary luminance variable area DA2 is an area in which the luminance is controlled to reduce the afterimage at the boundary of the letterbox area LA and the image display area DA. If the letterbox area LA is located on the top and the bottom of the display panel 110, the boundary luminance variable area DA2 may occupy approximately 10% of a vertical resolution of the display panel 110. If the letterbox area LA is located at the left side and the right side of the display panel 110, the boundary luminance variable area DA2 may occupy approximately 10% of a horizontal resolution of the display panel 110. However, a size of the boundary luminance variable area DA2 may vary depending on a design, and is not limited thereto.

Unlike the letterbox area LA, the image display area DA is an area in which the light emitting diode of the sub pixel SP emits light. Therefore, unlike the letterbox area LA in which the light emitting diode of the sub pixel SP does not emit light, in the image display area DA in which the light emitting diode of the sub pixel SP continuously emits light, the afterimage risk is high. Specifically, there is a high possibility that the user visually recognizes the afterimage at the boundary of the letterbox area LA and the image display area DA due to the afterimage deviation. Therefore, the luminance in the boundary luminance variable area DA2 of the image display area DA adjacent to the letterbox area LA is reduced to reduce the afterimage and to minimize visual recognition of the afterimage.

Figure 3:
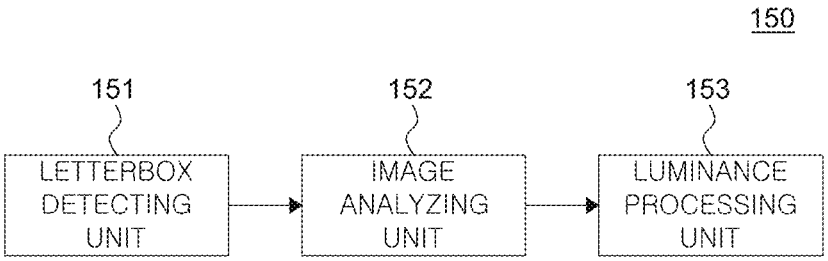
FIG. 3 is a diagram of a luminance control unit of a display device according to an exemplary embodiment of the present disclosure.

Referring to FIG. 3, the luminance control unit 150 controls an amount of reduced luminance of the boundary luminance variable area DA2 in consideration of a characteristic of an image displayed in the image display area DA. The luminance control unit 150 includes a letterbox detecting unit 151, an image analyzing unit 152, and a luminance processing unit 153.

The letterbox detecting unit 151 detects the letterbox area LA and the image display area DA from the display panel 110. The letterbox detecting unit 151 detects a state of sub pixels which form a plurality of rows and columns in the display panel 110 to detect the letterbox area LA and the image display area DA. A driving method of the letterbox detecting unit 151 will be described in more detail with reference to FIGS. 4 and 5.

The image analyzing unit 152 analyzes image data RGB corresponding to the boundary luminance variable area DA2, among image data RGB to detect a characteristic of the image. The image analyzing unit 152 distinguishes whether a part of an image corresponding to the boundary luminance variable area DA2 is a dynamic image or a static image. Further, the image analyzing unit 152 distinguishes whether the part of an image corresponding to the boundary luminance variable area DA2 is a complex image having a lot of edges or a simple image having few edges. The amount of reduced luminance of the boundary luminance variable area DA2 may be determined according to an analysis result of the image analyzing unit 152.

The luminance processing unit 153 controls a luminance of the boundary luminance variable area DA2 based on a characteristic of an image detected from the image analyzing unit 152. That is, the luminance processing unit 153 controls a luminance of the boundary luminance variable area DA2 based on the amount of reduced luminance of the boundary luminance variable area DA2 determined by the image analyzing unit 152. When an image is a complex image which is dynamic or has a lot of edges, the luminance processing unit 153 reduces the luminance of the boundary luminance variable area DA2 more. Alternatively, when the image is a simple image which is static or has few edges, the luminance processing unit 153 may reduce the luminance of the boundary luminance variable area DA2 less. In the case of the complex image which is dynamic or has a lot of edges, even though the luminance is reduced, the reduction in luminance is not easily perceived by the user. In contrast, in the case of the simple image which is static or has few edges, the luminance deterioration may be easily perceived by the user. Therefore, the luminance processing unit 153 increases the amount of reduced luminance in the complex image which is dynamic or has a lot of edges and reduces the amount of reduced luminance in the simple image which is static or has few edges. By doing this, the luminance degradation is not perceived by the user and the afterimage is reduced.

Hereinafter, a process of detecting the image display area DA and the letterbox area LA from the display panel 110 will be described with reference to FIGS. 4 and 5.

Figure 4:
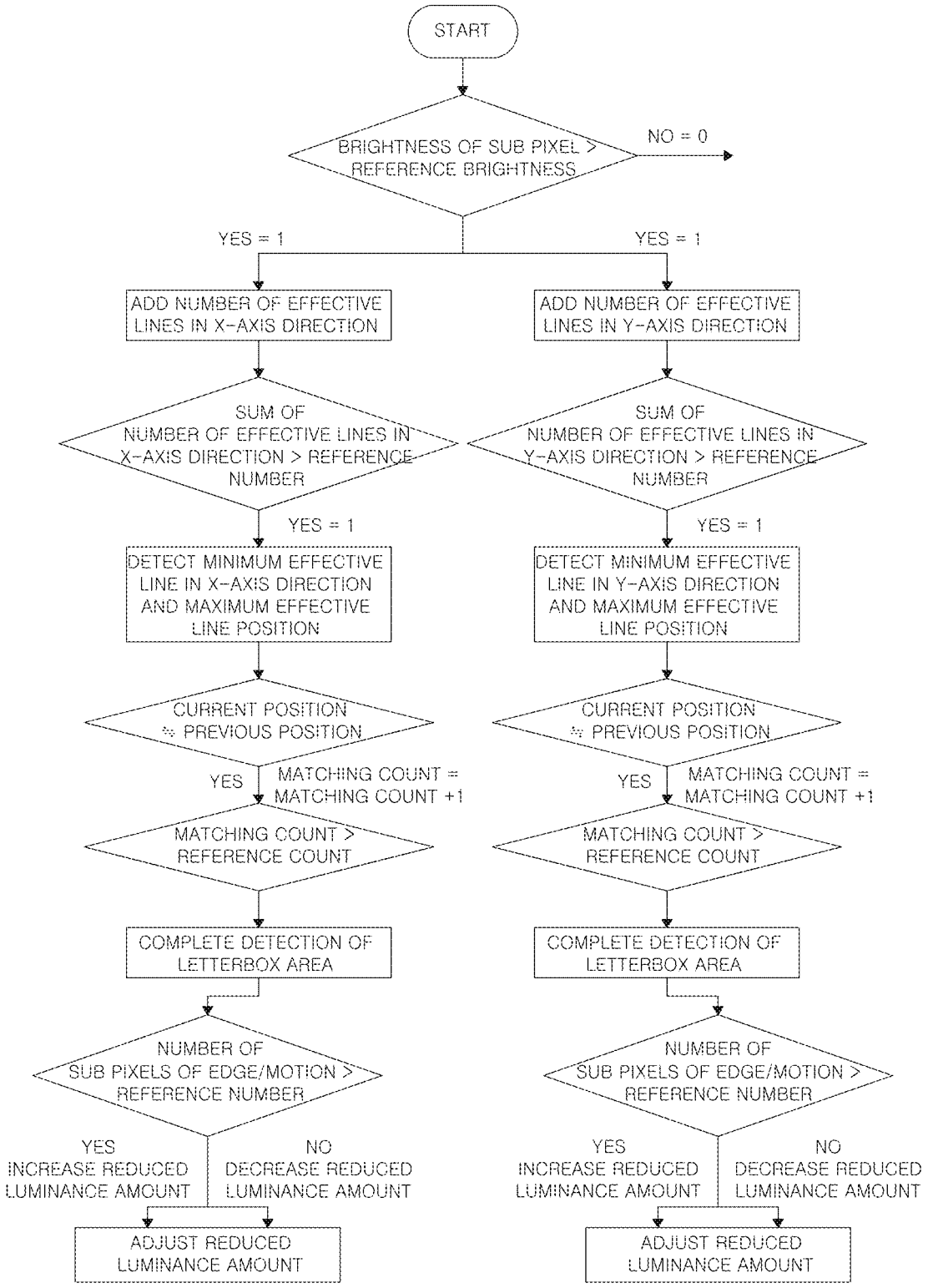
FIG. 4 is a flowchart for explaining a driving method of a display device according to an exemplary embodiment of the present disclosure.

FIG. 4 is a flowchart for explaining a driving method of a display device according to an exemplary embodiment of the present disclosure. FIG. 5 is an enlarged plan view of a display panel of a display device according to an exemplary embodiment of the present disclosure.

Referring to FIG. 4, the letterbox detecting unit 151 of the luminance control unit 150 detects the image display area DA and the letterbox area LA based on a brightness of the plurality of sub pixels SP. The letterbox detecting unit 151 detects a sub pixel SP which displays an image, among the plurality of sub pixels SP to detect a position of the image display area DA. The letterbox detecting unit 151 may detect the remaining area excluding the image display area DA as a letterbox area LA. The letterbox detecting unit 151 detects an effective line including a sub pixel SP which displays an image, among the plurality of sub pixels SP, and defines the positions of the letterbox area LA and the image display area DA based on the effective line.

First, the letterbox detecting unit 151 compares brightness of each of the plurality of sub pixels SP of the display panel 110 with a reference brightness. When the brightness of light emitted from each of the plurality of sub pixels SP is brighter than the reference brightness, the letterbox detecting unit 151 classifies to correspond to the image display area DA. In contrast, when the brightness of light emitted from each of the plurality of sub pixels SP is darker than the reference brightness, the letterbox detecting unit 151 classifies to correspond to the letterbox area LA.

Figure 5:
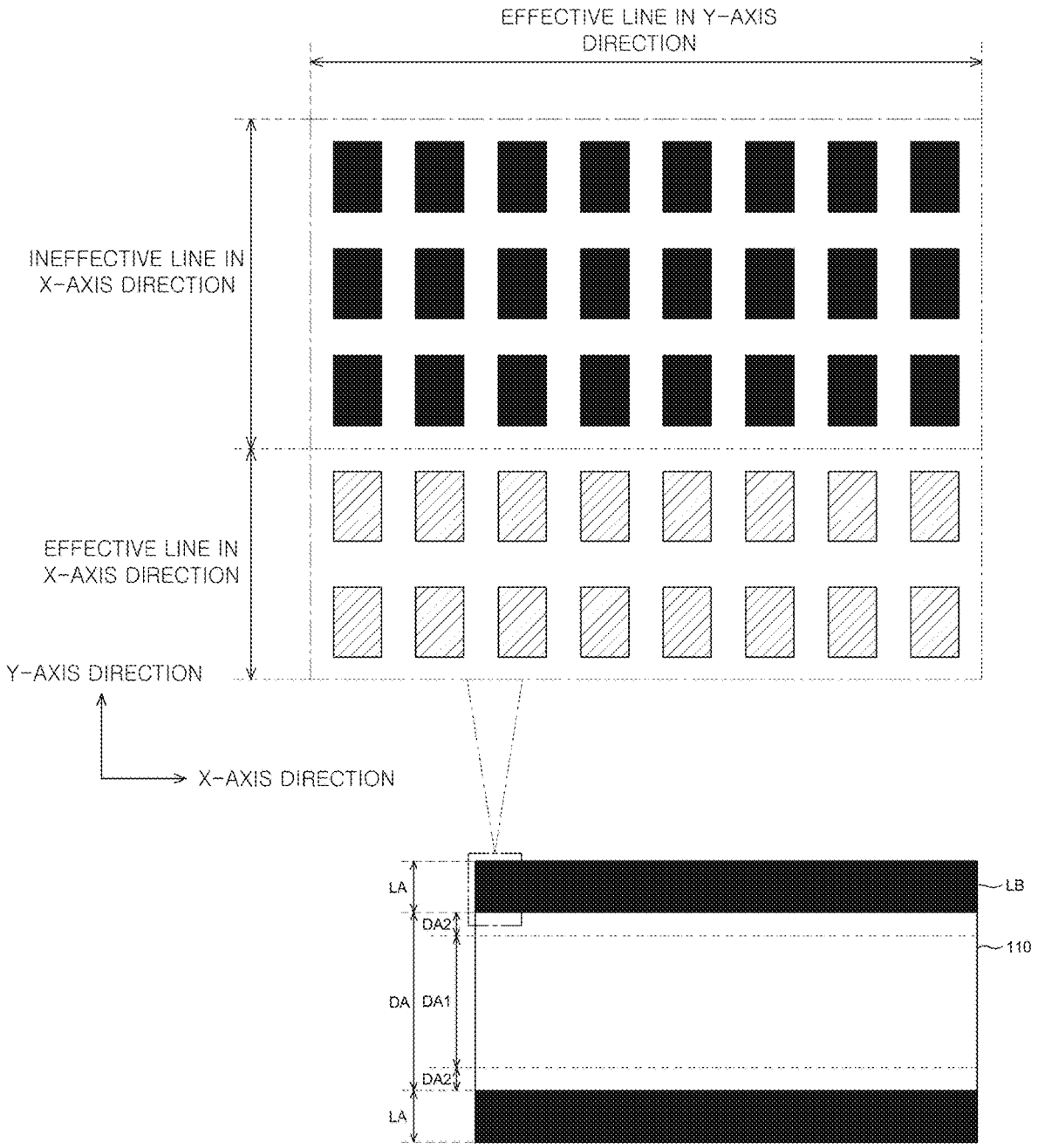
FIG. 5 is an enlarged plan view of a display panel of a display device according to an exemplary embodiment of the present disclosure.

In the meantime, referring to FIG. 5, the plurality of sub pixels SP is disposed in a plurality of lines along the x-axis direction and disposed in a plurality of lines along the y-axis direction. The letterbox detecting unit 151 inspects a sub pixel SP disposed in an x-axis direction line to detect a letterbox area LA disposed above and below the image display area DA. Further, the letterbox detecting unit 151 inspects a sub pixel SP disposed in a y-axis direction line to detect a letterbox area LA disposed at the left side and right side of the image display area DA. The letterbox detecting unit 151 inspects lines in the x-axis direction to detect a height and a position of each of the image display area DA and the letterbox area LA. Further, the letterbox detecting unit 151 inspects lines in the y-axis direction to detect a width and a position of each of the image display area DA and the letterbox area LA.

Referring to FIGS. 4 and 5, the letterbox detecting unit 151 detects an effective line including one or more sub pixels SP which has a brightness brighter than the reference brightness, among the plurality of lines disposed along the x-axis direction. The letterbox detecting unit 151 sequentially inspects from a sub pixel SP in an uppermost first line to a sub pixel SP of a lowermost last line, among the plurality of lines disposed along the x-axis direction.

For example, the letterbox detecting unit 151 may inspect the brightness of the plurality of sub pixels SP in the first line disposed along the x-axis direction. If the brightness of the plurality of sub pixels SP of the first line is darker than the reference brightness, the letterbox detecting unit 151 may classify that the first line does not display images. Next, if the brightness of the plurality of sub pixels SP of the second line and the third line is darker than the reference brightness, the letterbox detecting unit 151 may classify that the second line and the third line do not display images.

Next, when a brightness of at least some of the plurality of sub pixels SP in a fourth line disposed along the x-axis direction is brighter than the reference brightness, the letterbox detecting unit 151 may classify the fourth line as an effective line which displays images. Accordingly, the letterbox detecting unit 151 repeats the process of inspecting the brightness of the plurality of sub pixels SP from the first line to the last line to detect an effective line which displays images.

Next, the letterbox detecting unit 151 adds the number of effective lines to check whether to satisfy the reference number. The letterbox detecting unit 151 adds effective lines classified to display images to check whether the number of effective lines is larger than the reference number. At this time, the reference number may correspond to 50% of the number of the plurality of lines extending in the x-axis direction, but is not limited thereto.

For example, when the number of effective lines is larger than the reference number, an image is normally displayed on the display panel 110 and the effective lines are set to correspond to the image display area DA. In contrast, when the number of effective lines is smaller than the reference number, the display panel 110 does not display an image on more than half of the display panel 110 or the display panel 110 display a dark image on more than half of the display panel 110 so that the letterbox detecting unit 151 recognizes that there is no letterbox LB or the image is not normally displayed. Therefore, the letterbox detecting unit 151 may return to the first step of detecting the brightness of the plurality of sub pixels SP again.

Next, when a sum of the number of effective lines which is detected to display images is larger than a reference sum, the letterbox detecting unit 151 checks whether the positions of a minimum effective line and a maximum effective line are similar to the positions of a minimum effective line and a maximum effective line which are previously detected.

Specifically, an outermost effective line among lines detected to display an image may be set as a minimum effective line or a maximum effective line. For example, an uppermost effective line among the effective lines detected to display an image is set as the minimum effective line and a lowermost effective line is set as the maximum effective line.

The letterbox detecting unit 151 compares positions of the minimum effective line and the maximum effective line which are previously detected and positions of the minimum effective line and the maximum effective line which are currently detected to check whether the positions are similar. If the positions of the previous minimum effective line and the current minimum effective line match or are similar, or if the positions of the previous maximum effective line and the current maximum effective line match or are similar, a matching count may be counted.

For example, when the minimum effective line which is set at the time of previous detection of a letterbox LB is a fourth line and a currently set minimum effective line is also a fourth line, the letterbox detecting unit 151 may count the matching count.

At this time, as the reference count is increased, the detection accuracy of the letterbox area LA is improved, and as the reference count is reduced, the detection time of the letterbox area LA may be reduced. Accordingly, the reference count may be set in various manners in consideration of the accuracy and the detection time, but is not limited thereto.

Next, when the matching count of the positions of the minimum effective line and the maximum effective line exceeds the reference count, the letterbox detecting unit 151 classifies an area from the minimum effective line to the maximum effective line as the image display area DA, and classifies an area between the first line and the minimum effective line and an area between the maximum effective line and the last line as the letterbox area LA.

In summary, the letterbox detecting unit 151 inspects the brightness of the sub pixel SP of each of the plurality of lines extending along the x-axis direction to detect an effective line which is inferred by displaying images. If a total number of effective lines is larger than the reference number so that it is determined that the image is normally displayed, the step of comparing the positions of the minimum effective line and the maximum effective line with the previously detected minimum effective line and maximum effective line is repeated. Therefore, the height and the position of the image display area DA and the letterbox area LA may be detected.

Next, the letterbox detecting unit 151 inspects a plurality of lines extending along the y-axis direction to detect widths and positions of the image display area DA and the letterbox area LA. At this time, a process of detecting heights and positions of the image display area DA and the letterbox area LA and a process of detecting widths and positions are substantially the same except that the processes are performed along the x-axis direction or the y-axis direction.

Specifically, the letterbox detecting unit 151 detects an effective line including one or more sub pixels SP which has a brightness brighter than the reference brightness, among the plurality of lines disposed along the y-axis direction. The letterbox detecting unit 151 sequentially inspects from a sub pixel SP in a leftmost first line to a sub pixel SP of a rightmost last line, among the plurality of lines disposed along the y-axis direction.

For example, the letterbox detecting unit 151 inspects a brightness of the plurality of sub pixels SP in the first line. If the brightness of the plurality of sub pixels SP of the first line is brighter than the reference brightness, the letterbox detecting unit 151 may classify the first line as an effective line which displays an image. Next, if the brightness of the plurality of sub pixels SP of the second line to the fourth line is brighter than the reference brightness, the letterbox detecting unit 151 may classify the second line to the fourth line as effective lines which display images. Accordingly, the letterbox detecting unit 151 repeats the process of inspecting the brightness of the plurality of sub pixels SP from the leftmost first line to the rightmost last line to detect an effective line which displays images.

Next, the letterbox detecting unit 151 adds the number of effective lines to check whether to satisfy the reference number. The letterbox detecting unit 151 adds the number of effective lines classified to display images to check whether to be larger than the reference number. At this time, the reference number may correspond to 50% of the number of the plurality of lines extending in the y-axis direction, but is not limited thereto.

For example, when the number of effective lines is larger than the reference number, the image is normally displayed on the display panel 110 and the effective lines are set to correspond to the image display area DA. In contrast, when the number of effective lines is smaller than the reference number, the letterbox detecting unit 151 recognizes that there is no letterbox LB or the image is not normally displayed. Therefore, the letterbox detecting unit 151 may return to the first step of detecting the brightness of the plurality of sub pixels SP again.

Next, when a sum of the number of effective lines which is detected to display images is larger than a reference sum, the letterbox detecting unit 151 checks whether the positions of a minimum effective line and a maximum effective line are similar to the positions of a minimum effective line and a maximum effective line which are previously detected.

Specifically, an outermost effective line among lines detected to display an image is set as a minimum effective line or a maximum effective line. For example, a leftmost effective line among the effective lines detected to display an image is set as the minimum effective line and a rightmost effective line is set as the maximum effective line.

The letterbox detecting unit 151 compares positions of the minimum effective line and the maximum effective line which are previously detected and positions of the minimum effective line and the maximum effective line which are currently detected to check whether the positions are similar. If the positions of the previous minimum effective line and the current minimum effective line match or are similar, or if the positions of the previous maximum effective line and the current maximum effective line match or are similar, a matching count may be counted. The letterbox detecting unit 151 counts the matching count even when the previous and current positions of the minimum effective line and maximum effective lines has an error of at most 1%.

For example, when the minimum effective line which is set at the time of previous detection of a letterbox LB is a first line and a currently set minimum effective line is also a first line, the letterbox detecting unit 151 may count the matching count.

Next, when the matching count of the positions of the minimum effective line and the maximum effective line exceeds the reference count, the letterbox detecting unit 151 classifies an area from the minimum effective line to the maximum effective line as the image display area DA and classifies an area between the first line and the minimum effective line and an area between the maximum effective line and the last line as the letterbox area LA.

In summary, the letterbox detecting unit 151 inspects a brightness of the sub pixel SP of each of a plurality of lines extending along the y-axis direction to detect an effective line which is inferred to display images. If a total number of effective lines is larger than the reference number so that it is determined that an image is normally displayed, the step of comparing the positions of the minimum effective line and the maximum effective line with the previously detected minimum effective line and maximum effective line is repeated. Therefore, the width and the position of the image display area DA and the letterbox area LA may be detected.

Accordingly, the letterbox detecting unit 151 inspects sub pixels SP of the plurality of lines extending in the x-axis direction and inspects sub pixels SP of the plurality of lines extending in the y-axis direction to detect the image display area DA and the letterbox area LA.

In the meantime, even though the image display area DA is detected to be contracted, the luminance control unit 150 may maintain the letterbox area LA. The letterbox detecting unit 151 may consistently inspect the sub pixel SP after detecting the letterbox area LA and the image display area DA. When an effective line is detected from the letterbox area LA, since the ratio of the image to be displayed is changed so that an image is displayed even in the letterbox area LA, the letterbox detecting unit 151 newly detects or removes the letterbox area LA from the display panel 110.

In contrast, after detecting the letterbox area LA, when it is detected that the minimum effective line and the maximum effective line are in the image display area DA, the letterbox detecting unit 151 may maintain the letterbox area LA for at least a predetermined time. In this case, when the image display area DA adjacent to the letterbox area LA displays black, it looks as if the letterbox area LA is extended into the image display area DA. Therefore, even though the minimum and maximum effective lines are detected in the image display area DA, the letterbox detecting unit 151 may continuously maintain the letterbox area LA for a predetermined time, for example, for an N-th frame. If the minimum and maximum effective lines are detected in the image display area DA even after the N-th frame, the letterbox area LA and the image display area DA may be newly changed.

Hereinafter, a process of controlling a luminance of a boundary luminance variable area DA2 when a static or simple image is displayed will be described with reference to FIGS. 4, and 6A to 7B.

Figure 6A:
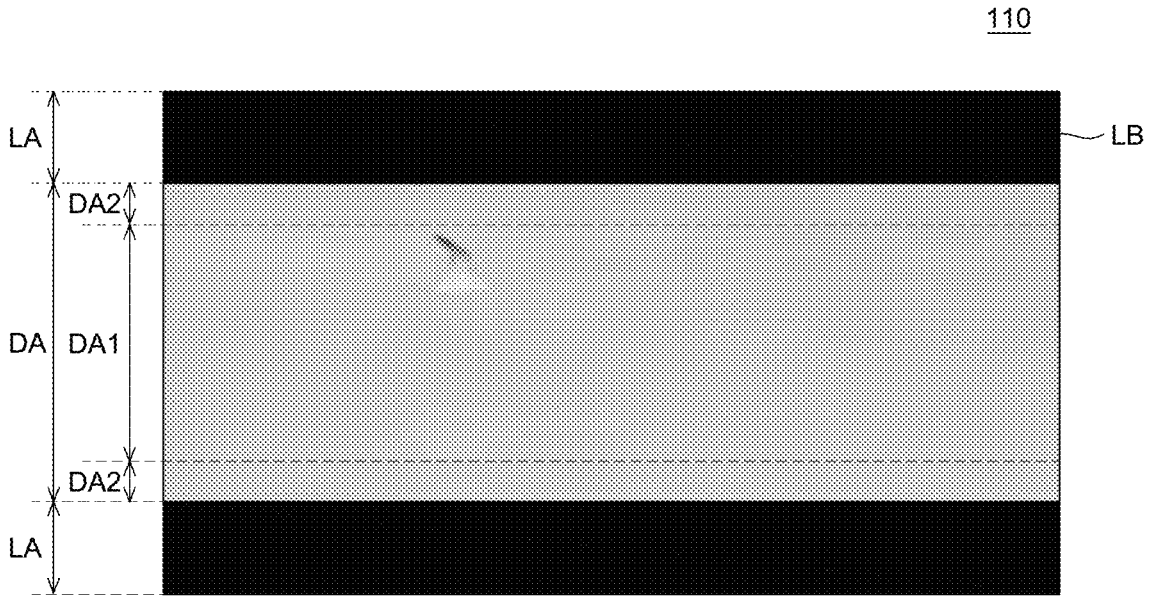
FIGS. 6A to 7B are plan views of a display panel for explaining a process of controlling a luminance of a display device according to an exemplary embodiment of the present disclosure.
Figure 6B:
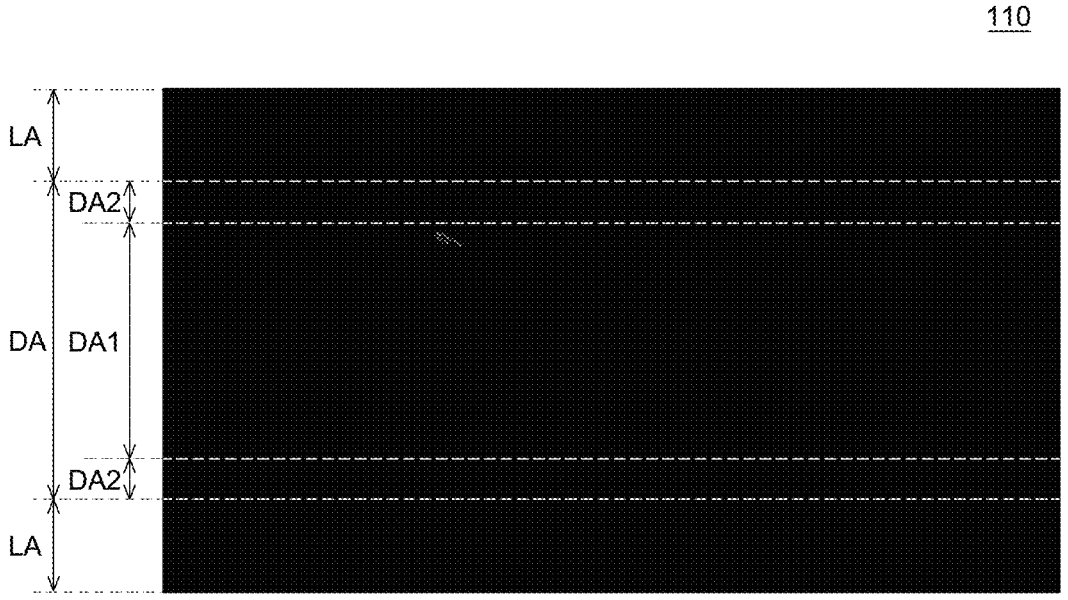
Figure 6C:
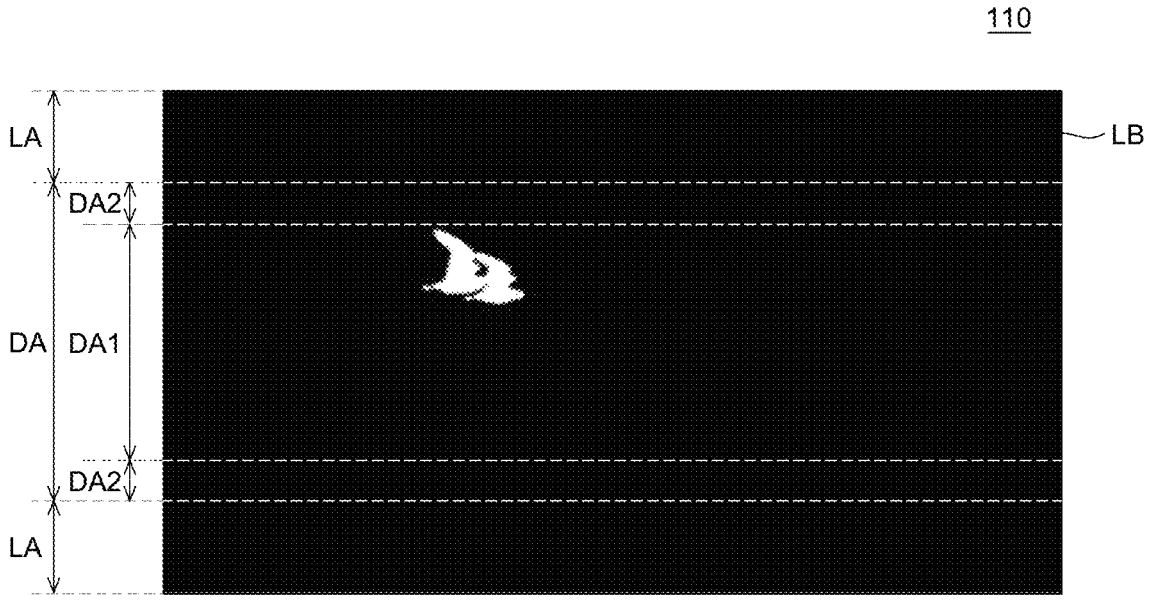
Figure 7A:
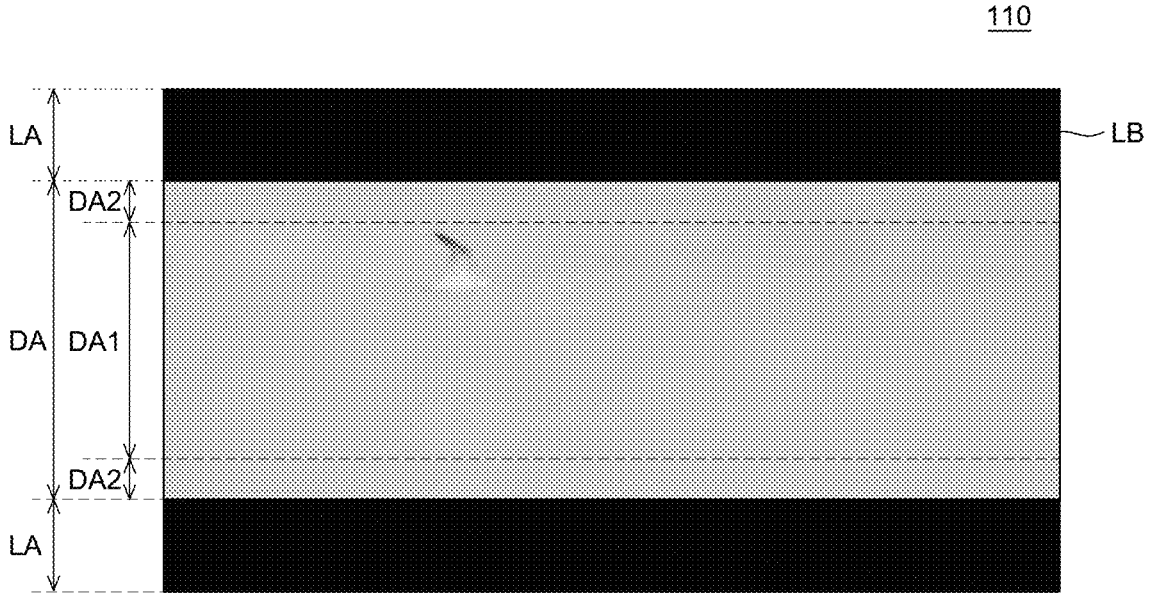
FIG. 7C is a plan view for explaining an effect of minimizing a display quality degradation in a luminance control process of a display device according to an exemplary embodiment of the present disclosure.
Figure 7B:
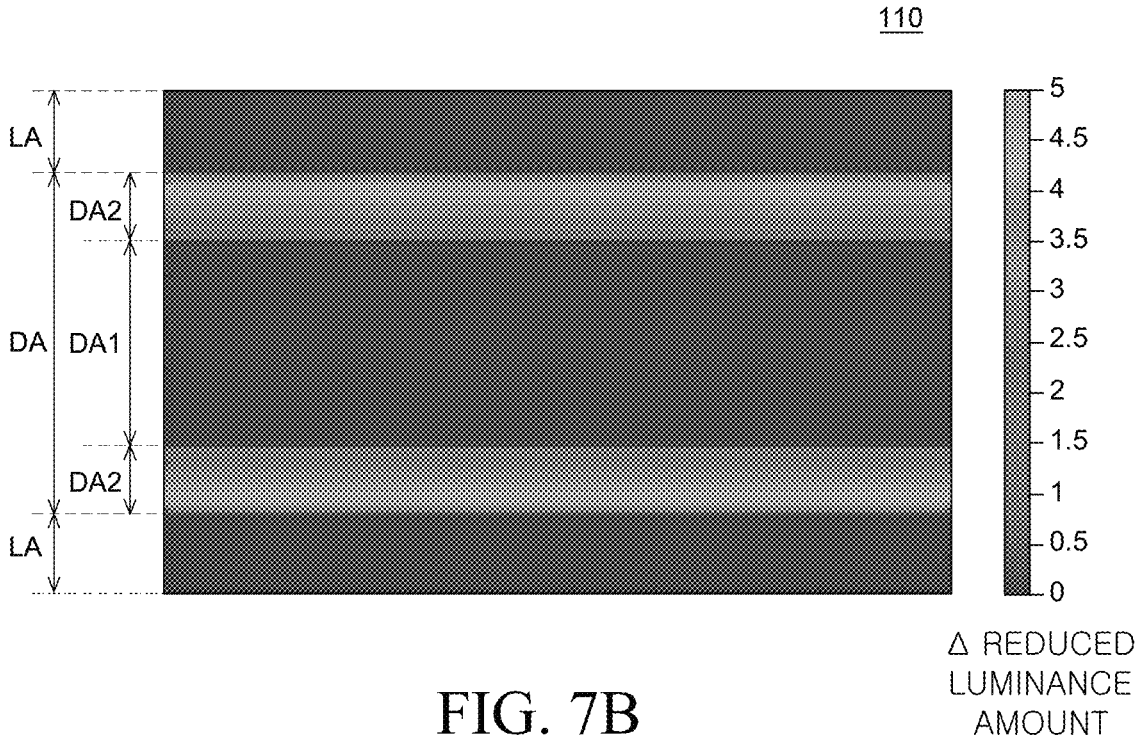

FIGS. 6A to 7B are plan views of a display panel for explaining a process of controlling a luminance of a display device according to an exemplary embodiment of the present disclosure. FIG. 7C is a plan view for explaining an effect of minimizing a display quality degradation in a luminance control process of a display device according to an exemplary embodiment of the present disclosure. FIGS. 6A to 7B are views for explaining a process of controlling a luminance of a boundary luminance variable area DA2 when a static or simple image is displayed. FIG. 6A is a plan view for explaining an image which is displayed on the display panel 110 of the display device 100 according to an exemplary embodiment of the present disclosure. FIG. 6B is a view illustrating an edge map for the image of FIG. 6A. FIG. 6C is a view illustrating a motion map for the image of FIG. 6A. FIG. 7A is a plan view for explaining an image which is displayed on the display panel 110 after controlling a luminance of the boundary luminance variable area DA2. FIG. 7B is a view illustrating variation of a reduced luminance amount for the entire area of the display panel 110. FIG. 7C is a plan view for explaining an image which is displayed on the display panel 110 when the reduced luminance amount is determined without considering an image characteristic of the boundary luminance variable area DA2.

Next, referring to FIGS. 4 and 6A together, the image analyzing unit 152 analyzes an image displayed in the boundary luminance variable area DA2 to determine a reduced luminance amount of the boundary luminance variable area DA2. If a number of sub pixels SP corresponding to an edge or a number of sub pixels SP corresponding to a motion, among the plurality of sub pixels SP of the boundary luminance variable area DA2, is larger than a reference number, the image analyzing unit 152 may increase the reduced luminance amount of the boundary luminance variable area DA2. If the number is smaller than the reference number, the image analyzing unit 152 may reduce the reduced luminance amount of the boundary luminance variable area DA2.

Specifically, in the display panel 110, a static or simple image as illustrated in FIG. 6A may be displayed. The image analyzing unit 152 may determine a reduced luminance amount based on an edge map and a motion map of the image which is displayed on the display panel 110.

FIG. 6B is an edge map for the image of FIG. 6A so that an edge of an object present in the image may be identified. For example, from the edge map, an edge of a bird in the sky may be identified.

The image analyzing unit 152 may detect a sub pixel SP corresponding to an edge, among sub pixels SP of the boundary luminance variable area DA2, from the edge map. If the number of sub pixels SP corresponding to the edge, among the sub pixels SP of the boundary luminance variable area DA2 is larger than the reference number, the reduced luminance amount of the boundary luminance variable area DA2 may be increased. In contrast, if the number of sub pixels SP corresponding to the edge, among the sub pixels SP of the boundary luminance variable area DA2 is smaller than the reference number, the reduced luminance amount of the boundary luminance variable area DA2 may be reduced. That is, the larger the number of sub pixels SP corresponding to the edge, the more the luminance of the boundary luminance variable area DA2 is reduced. The smaller the number of sub pixels SP corresponding to the edge, the less the luminance of the boundary luminance variable area DA2 is reduced. At this time, the reference number may be set to approximately 50% of the number of the plurality of sub pixels SP of the boundary luminance variable area DA2 or set in various manners depending on the design, but is not limited thereto.

In this case, in FIG. 6B, it may be confirmed that in the boundary luminance variable area DA2, the sub pixel SP corresponding to the edge is not disposed and the luminance control unit 150 may reduce the reduced luminance amount of the boundary luminance variable area DA2.

Next, FIG. 6C is a motion map of an image of FIG. 6A so that it may be identified whether the image is a dynamic image with a lot of motions of an object. The motion map may represent whether content displayed in a previous frame and a current frame is different in each of a plurality of sub pixels SP. For example, in order to display a motion of a bird flying in the sky, sub pixels SP which display the bird may vary for every frame. Therefore, in FIG. 6C, a sub pixel SP corresponding to the motion of the bird is disposed in the boundary luminance non-variable area DA1 and a sub pixel SP corresponding to the motion is not disposed in the boundary luminance variable area DA2.

Accordingly, the image analyzing unit 152 analyzes a motion map to detect a number of sub pixels SP corresponding to the motion disposed in the boundary luminance variable area DA2, that is, a number of sub pixels SP in which an image displayed in the current frame is different from an image displayed in the previous frame. The detected number of sub pixels SP may be compared with the reference number. In this case, there is no sub pixel SP corresponding to the motion in the boundary luminance variable area DA2, so that the image analyzing unit 152 may reduce the reduced luminance amount of the boundary luminance variable area DA2.

In summary, the image analyzing unit 152 detects a number of sub pixels SP corresponding to the edge or a number of sub pixels SP corresponding to the motion, among the sub pixels SP of the boundary luminance variable area DA2. If the number of sub pixels SP corresponding to the edge or the motion satisfies the reference number, the image analyzing unit 152 increases the reduced luminance amount. Further, when all the numbers of sub pixels SP corresponding to the edge and the motion satisfy the reference number, the reduced luminance amount of the boundary luminance variable area DA2 may be further increased rather than a case when only one of the number of the sub pixels SP corresponding to the edge and the number of the sub pixels SP corresponding to the motion satisfies the reference number. As the number of sub pixels SP corresponding to the motion or the number of sub pixels SP corresponding to the edge is increased, the image analyzing unit 152 may increase the reduced luminance amount of the boundary luminance variable area DA2. In contrast, when the number of the sub pixels SP corresponding to the edge or the motion does not satisfy the reference number, the image analyzing unit 152 may reduce the reduced luminance amount.

Accordingly, in the image as illustrated in FIG. 6A, there is no sub pixel SP corresponding to the edge or the motion, among the plurality of sub pixels SP of the boundary luminance variable area DA2, so that the reduced luminance amount of the boundary luminance variable area DA2 may be reduced. Further, the luminance of the boundary luminance variable area DA2 may be lowered to the minimum.

Next, referring to FIGS. 7A and 7B together, the luminance processing unit 153 controls a luminance of the boundary luminance variable area DA2 based on the reduced luminance amount determined by the image analyzing unit 152. For example, when the image analyzing unit 152 determines the reduced luminance amount of the boundary luminance variable area DA2 to 5%, the luminance processing unit 153 may reduce the luminance of the boundary luminance variable area DA2 by 5% of the existing luminance.

At this time, the luminance processing unit 153 may gradually reduce the luminance of the boundary luminance variable area DA2 to minimize that the luminance reduction is perceived by the user. In the boundary luminance variable area DA2, a luminance of an area most adjacent to the letterbox area LA is reduced the most and the reduced luminance amount may be gradually reduced toward the boundary luminance non-variable area DA1. That is, the luminance of the boundary luminance variable area DA2 may be reduced by gradation.

Specifically, referring to FIG. 7B, the variation of the reduced luminance amount of the letterbox area LA and the boundary luminance non-variable area DA1 is 0% so that it is confirmed that the existing luminance is maintained. It is confirmed that a variation of the reduced luminance amount of a part of the boundary luminance variable area DA2 which is the most adjacent to the letterbox area LA is at most 5%. Further, as it is closer to the boundary luminance non-variable area DA1, a variation of the reduced luminance amount of the boundary luminance variable area DA2 is gradually reduced to be close to 0%. Accordingly, the luminance processing unit 153 gradually reduces the luminance of the boundary luminance variable area DA2 toward the boundary luminance non-variable area DA1 from the letterbox area LA to minimize the luminance reduction from being visually recognized as a bar.

In summary, in the display device 100 according to an exemplary embodiment of the present disclosure, the reduction rate of the luminance of the boundary luminance variable area DA2 may be controlled by considering a characteristic of an image to be displayed. Specifically, when the image is static or simple, the luminance reduction rate of the boundary luminance variable area DA2 may be reduced.

Figure 7C:
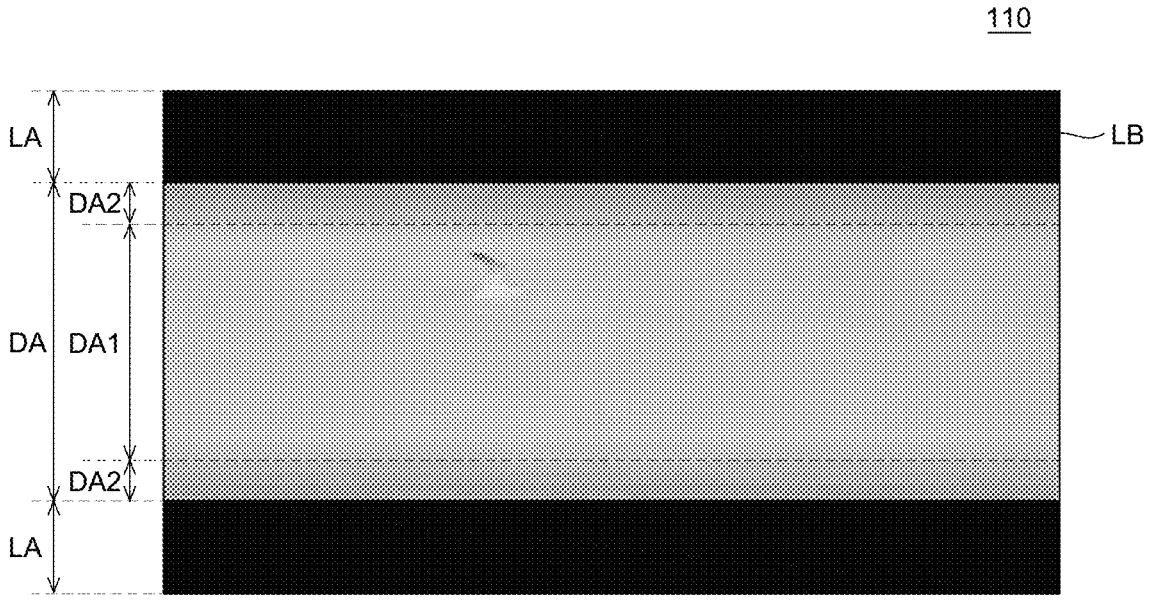

If the luminance reduction rate of the boundary luminance variable area DA2 is arbitrarily controlled without considering a characteristic of an image, unlike the display device 100 according to an exemplary embodiment of the present disclosure, as illustrated in FIG. 7C, the luminance reduction may be visually recognized as a bar.

Figure 8A:
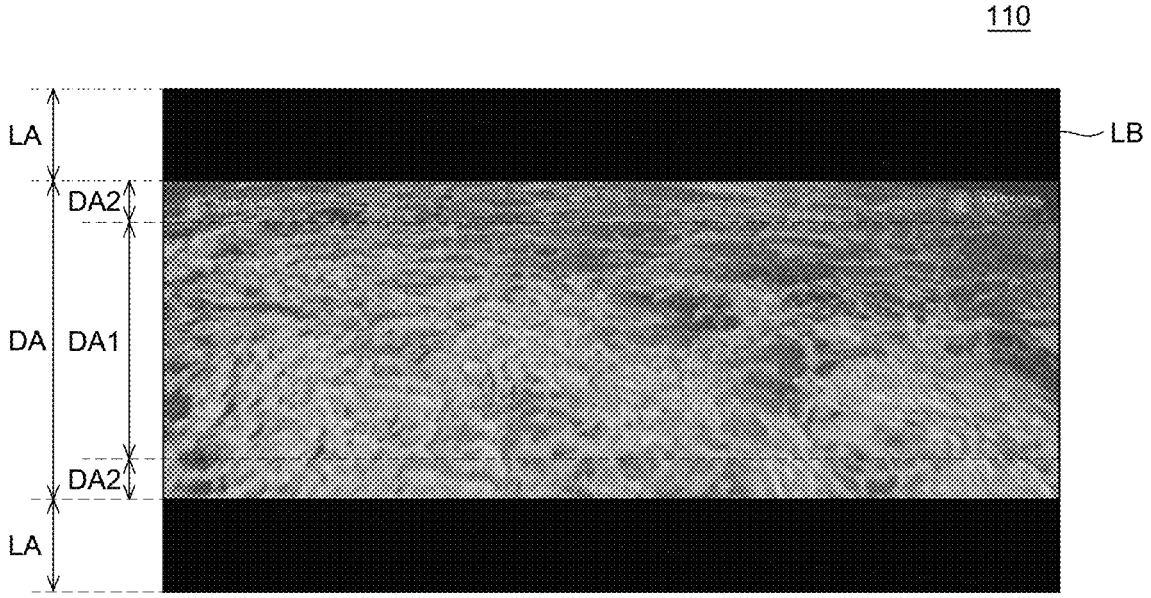
FIGS. 8A to 9B are plan views of a display panel for explaining a process of controlling a luminance of a display device according to an exemplary embodiment of the present disclosure.

For example, when the luminance of the boundary luminance variable area DA2 in the image of FIG. 6A is reduced by 20%, an image as illustrated in FIG. 7C may be obtained. FIG. 7A in which a luminance of the boundary luminance variable area DA2 is reduced by 5% in consideration of a characteristic of an image and FIG. 7C in which a luminance of the boundary luminance variable area DA2 is reduced by a specific value, for example, 20% without considering the characteristic of the image are compared. Therefore, it is confirmed that in FIG. 7A, the luminance reduction of the boundary luminance variable area DA2 is not visually recognized, but in FIG. 7C, the luminance reduction of the boundary luminance variable area DA2 is visually recognized as a bar. Specifically, when a dynamic or complex image as illustrated in FIG. 8A to be described below is displayed, even though the luminance reduction rate of the boundary luminance variable area DA2 is increased, the luminance reduction is not easily perceived. In contrast, when a static or simple image as illustrated in FIG. 6A is displayed, the luminance variation of the boundary luminance variable area DA2 may be easily perceived. Accordingly, the luminance control unit 150 of the display device 100 according to an exemplary embodiment of the present disclosure detects and analyzes the characteristic of the image. Therefore, the luminance reduction rate of the boundary luminance variable area DA2 is reduced, as the image is static or simple. By doing this, the display quality degradation in the boundary luminance variable area DA2 may be minimized while improving the afterimage deviation between the boundary luminance variable area DA2 and the letterbox area LA.

Hereinafter, a process of controlling a luminance of a boundary luminance variable area DA2 when a dynamic or complex image is displayed will be described with reference to FIGS. 8A to 9B.

Figure 8B:
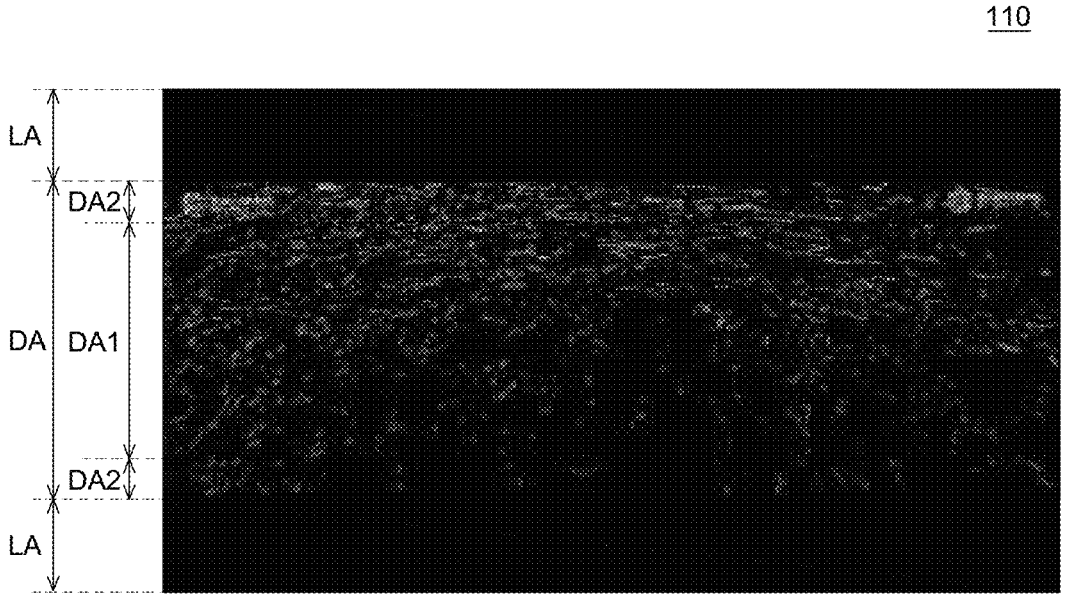
Figure 8C:
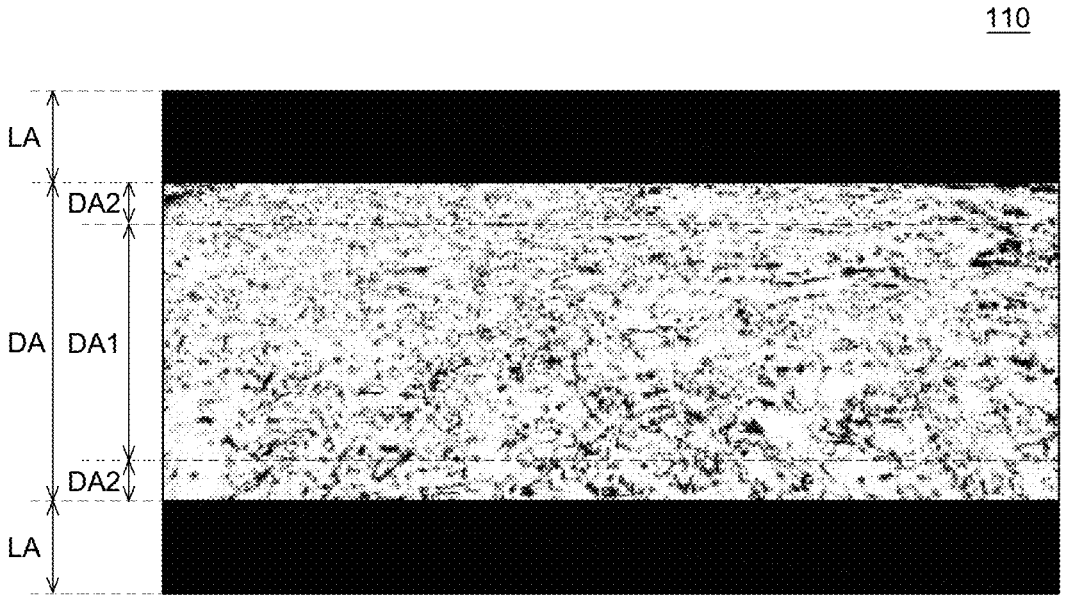
Figure 9A:
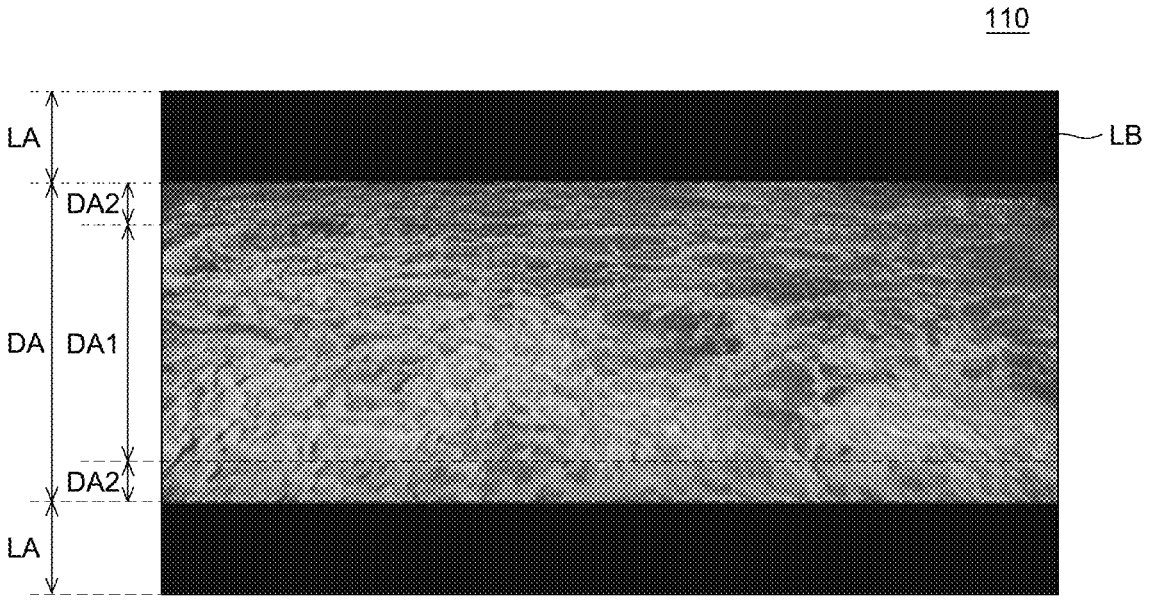
Figure 9B:
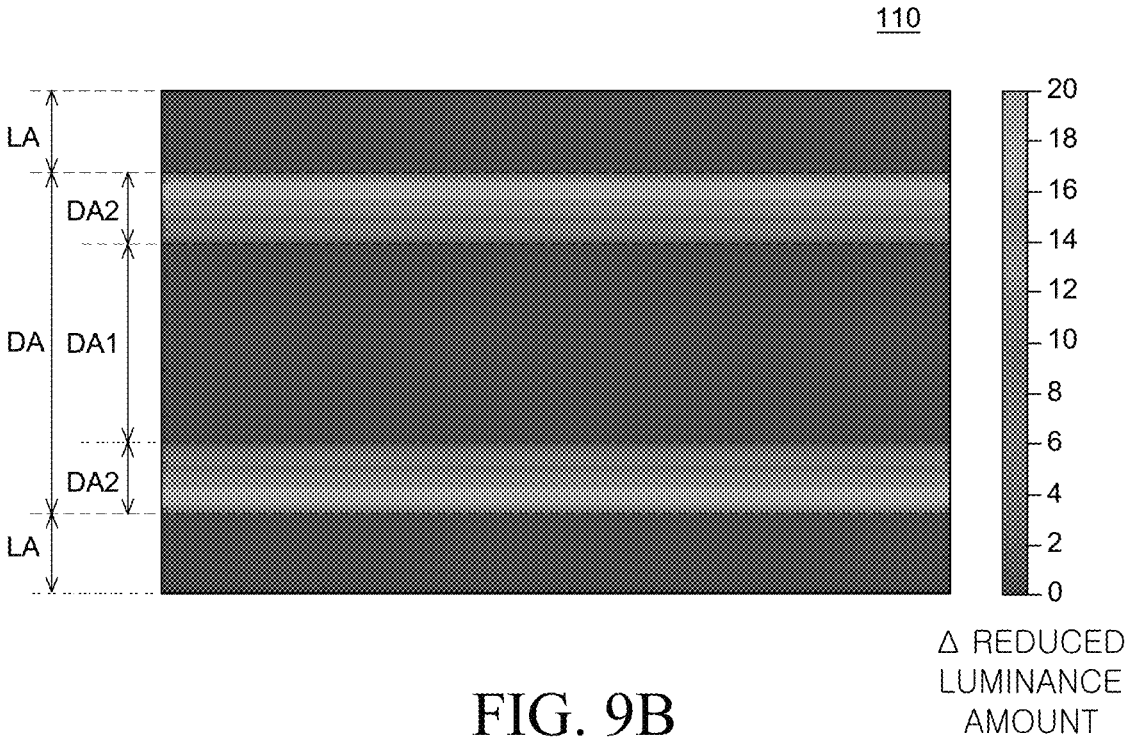

FIGS. 8A to 9B are plan views of a display panel for explaining a process of controlling a luminance of a display device according to an exemplary embodiment of the present disclosure. FIGS. 8A to 9B are views for explaining a process of controlling a luminance of a boundary luminance variable area DA2 when a dynamic or complex image is displayed. FIG. 8A is a plan view for explaining an image which is displayed on the display panel 110 of the display device 100 according to an exemplary embodiment of the present disclosure. FIG. 8B is a view illustrating an edge map for the image of FIG. 8A. FIG. 8C is a view illustrating a motion map for the image of FIG. 8A. FIG. 9A is a plan view for explaining an image which is displayed on the display panel 110 after controlling a luminance of the boundary luminance variable area DA2. FIG. 9B is a view illustrating a variation of a reduced luminance amount for the entire area of the display panel 110.

In the display panel 110, a dynamic or complex image as illustrated in FIG. 8A may be displayed. The luminance control unit 150 may determine the reduced luminance amount of the boundary luminance variable area DA2 based on the edge map and the motion map for the image of FIG. 8A.

Referring to FIG. 8B, the edge map for the image of FIG. 8A is identified. In FIG. 8A, an edge with a wave shape and an edge with a bobble shape are identified.

The image analyzing unit 152 may detect a sub pixel SP corresponding to an edge, among the plurality of sub pixels SP of the boundary luminance variable area DA2, from the edge map. In FIG. 8B, it may be confirmed that most of the plurality of sub pixels SP of the boundary luminance variable area DA2 are sub pixels SP corresponding to the edge. Accordingly, since the number of sub pixels SP corresponding to the edge, among the plurality of sub pixels SP of the boundary luminance variable area DA2, is larger than the reference number, the image analyzing unit 152 may increase the reduced luminance amount of the boundary luminance variable area DA2.

Next, referring to FIG. 8C, a motion map for the image of FIG. 8A is identified. In order to display a motion of the wave, content for every frame to be displayed may vary in most of the plurality of sub pixels SP. In FIG. 8C, it may be confirmed that most of the plurality of sub pixels SP of the display panel 110 are sub pixels SP corresponding to the motion. Accordingly, since the number of sub pixels SP corresponding to the motion, among the plurality of sub pixels SP of the boundary luminance variable area DA2, is larger than the reference number, the image analyzing unit 152 may increase the reduced luminance amount of the boundary luminance variable area DA2. Further, the image analyzing unit 152 may lower the luminance of the boundary luminance variable area DA2 as much as possible.

Referring to FIGS. 9A and 9B, the luminance processing unit 153 controls a luminance of the boundary luminance variable area DA2 based on the reduced luminance amount determined by the image analyzing unit 152. For example, when the image analyzing unit 152 determines the reduced luminance amount of the boundary luminance variable area DA2 to 20%, the luminance processing unit 153 may reduce the luminance of the boundary luminance variable area DA2 by 20% of the existing luminance.

The luminance processing unit 153 may gradually reduce the luminance of the boundary luminance variable area DA2 to suppress the luminance reduction from being perceived as a bar. In the boundary luminance variable area DA2, a luminance of an area most adjacent to the letterbox area LA is reduced the most. The reduced luminance amount may be gradually reduced, as the boundary luminance non-variable area DA1 is closer. That is, the luminance of the boundary luminance variable area DA2 may be reduced by gradation.

Referring to FIG. 9B, the variation of the reduced luminance amount of the letterbox area LA and the boundary luminance non-variable area DA1 is 0% m so that it may be confirmed that the existing luminance is maintained. It is confirmed that a variation of the reduced luminance amount of a part of the boundary luminance variable area DA2 which is the most adjacent to the letterbox area LA is at most 20%. Further, as it is closer to the boundary luminance non-variable area DA1, a variation of the reduced luminance amount of the boundary luminance variable area DA2 is gradually reduced to be close to 0%. Accordingly, the luminance processing unit 153 gradually reduces the luminance of the boundary luminance variable area DA2 toward the boundary luminance non-variable area DA1 from the letterbox area LA to minimize the luminance reduction from being visually recognized as a bar.

In the meantime, even though it is not illustrated in the drawings, the luminance processing unit 153 adjusts a luminance reduction rate in the unit of frames to suppress the flickering. The luminance processing unit 153 may gradually reduce the luminance of the boundary luminance variable area DA2 over N frames. For example, when the luminance of the boundary luminance variable area DA2 is reduced by X %, the luminance processing unit 153 may gradually reduce the luminance of the boundary luminance variable area DA2 by 1%, 2%, . . . , X−1%, and X % for N frames. If the luminance processing unit 153 reduces the luminance of the boundary luminance variable area DA2 by X % at one time, the luminance variation is recognized as flickering. Accordingly, the luminance processing unit 153 gradually varies the luminance of the boundary luminance variable area DA2 to reduce the flickering.

Accordingly, in the display device 100 according to an exemplary embodiment of the present disclosure, the luminance of an area of the image display area DA adjacent to the letterbox area LA is reduced to reduce the afterimage between the letterbox area LA and the image display area DA. The image display area DA which continuously displays an image has a higher afterimage risk than the letterbox area LA displayed with black. If the afterimage is generated in the image display area DA due to the degradation, the afterimage of the image display area DA may be easily visually recognized at the boundary of the image display area DA and the letterbox area LA. Accordingly, a luminance of the boundary luminance variable area DA2 which is a part of the image display area DA adjacent to the letterbox area LA is reduced to minimize the degradation and the afterimage of the light emitting diode. Accordingly, the display device 100 according to an exemplary embodiment of the present disclosure reduces the luminance of the boundary luminance variable area DA2 adjacent to the letterbox area LA to reduce the afterimage deviation between the letterbox area LA and the image display area DA. By doing this, the display quality may be improved.

In the display device 100 according to an exemplary embodiment of the present disclosure, the luminance reduction rate of the boundary luminance variable area DA2 may be controlled in consideration of a characteristic of an image to be displayed. In order to minimize the visual recognition of the afterimage deviation at the boundary between the letterbox area LA and the image display area DA, the luminance of the boundary luminance variable area DA2 adjacent to the letterbox area LA is reduced to reduce the afterimage. However, when the same luminance reduction rate is applied to the boundary luminance variable area DA2, the luminance reduction is not easily visually recognized by the user in the dynamic or complex image, but is easily visually recognized by the user in the static or simple image. For example, when the luminance reduction rate of the boundary luminance variable area DA2 is fixed to 20% without considering a characteristic of an image, in the dynamic or complex image, the luminance reduction is not easily visually recognized as illustrated in FIG. 9A. However, in the static or simple image, the luminance reduction is visually recognized as a bar as illustrated in FIG. 7C. Therefore, the edge map or the motion map of the image displayed in the boundary luminance variable area DA2 is analyzed to determine a luminance reduction rate of the boundary luminance variable area DA2. For example, when an image is analyzed as dynamic or complex from the edge map and the motion map, the luminance reduction rate of the boundary luminance variable area DA2 is increased to reduce the luminance more than that in a case that another image is displayed. For example, when an image is analyzed as static or simple from the edge map and the motion map, the luminance reduction rate of the boundary luminance variable area DA2 is reduced to reduce the luminance less than that in a case that another image is displayed. Accordingly, the display device 100 according to an exemplary embodiment of the present disclosure adjusts a luminance reduction rate of the boundary luminance variable area DA2 based on a characteristic of an image to be displayed. Accordingly, the visual recognition of the luminance reduction may be minimized while improving an afterimage deviation between the letterbox area LA and the image display area DA.

In the display device 100 according to an exemplary embodiment of the present disclosure, the luminance of the boundary luminance variable area DA2 is applied as gradation to minimize the visual recognition of the luminance reduction as a bar. The boundary luminance variable area DA2 may occupy 10% of a vertical or horizontal resolution of the display panel 110. When the luminance of the entire boundary luminance variable area DA2 is equally reduced, the luminance contrast of the boundary luminance non-variable area DA1 and the boundary luminance variable area DA2 may be visually recognized.

Accordingly, the luminance of the boundary luminance variable area DA2 gradually varies from the letterbox area LA to the boundary luminance non-variable area DA1 to relieve the visual recognition of the luminance contrast of the boundary luminance variable area DA2 and the boundary luminance non-variable area DA1. For example, the reduced luminance amount of the boundary luminance variable area DA2 adjacent to the letterbox area LA is the largest and is gradually reduced toward the boundary luminance non-variable area DA1. Further, a luminance of the boundary luminance variable area DA2 adjacent to the boundary luminance non-variable area DA1 may be adjusted to a similar level. Accordingly, in the display device 100 according to an exemplary embodiment of the present disclosure, the luminance of the boundary luminance variable area DA2 varies by gradation to initialize the luminance lowering of the boundary luminance variable area DA2 which is seen as a bar and to improve the display quality.

The exemplary embodiments of the present disclosure can also be described as follows:

According to an aspect of the present disclosure, there is provided a display device. The display device includes a display panel which includes a letterbox area and an image display area which displays an image and includes a boundary luminance variable area extending from the letterbox area, and a luminance control unit which controls a reduced luminance amount of the boundary luminance variable area based on the image.

The luminance control unit may analyze an edge map for an image which is displayed in the boundary luminance variable area to increase the reduced luminance amount of the boundary luminance variable area when a number of sub pixels corresponding to an edge, among a plurality of sub pixels of the boundary luminance variable area, is larger than a reference number.

When a number of sub pixels corresponding to the edge, among the plurality of sub pixels of the boundary luminance variable area, is smaller than the reference number, the luminance control unit may reduce the reduced luminance amount of the boundary luminance variable area.

The luminance control unit may analyze a motion map for an image which is displayed in the boundary luminance variable area to reduce the reduced luminance amount of the boundary luminance variable area when a number of sub pixels corresponding to a motion, among a plurality of sub pixels of the boundary luminance variable area, is smaller than the reference number.

When a number of sub pixels corresponding to the motion, among the plurality of sub pixels of the boundary luminance variable area, is larger than the reference number, the luminance control unit may increase the reduced luminance amount of the boundary luminance variable area.

The luminance control unit may gradually increase a luminance of the boundary luminance variable area along a direction directed to the inside of the image display area from the letterbox area.

According to another aspect of the present disclosure, there is provided a display device. The display device includes a display panel in which a letterbox area and an image display area which is disposed at one side of the letterbox area and displays an image are defined, and a luminance control unit which analyzes an image to reduce a luminance of a boundary luminance variable area of the image display area adjacent to the letterbox area. When a dynamic image, between a static image and the dynamic image, is displayed, the luminance control unit reduces a luminance of the boundary luminance variable area more.

The luminance control unit may include a letterbox detecting unit which detects the letterbox area, an image analyzing unit which analyzes a part of an image corresponding to the boundary luminance variable area, and a luminance processing unit which controls a reduced luminance amount of the boundary luminance variable area based on an analysis result of the image analyzing unit.

The letterbox detecting unit may detect an effective line including a sub pixel which displays an image, among a plurality of sub pixels of the display panel and define positions of the letterbox area and the image display area based on the effective line.

As the image is more dynamic, the image analyzing unit may increase a reduced luminance amount of the boundary luminance variable area based on a motion map of the image and as the image is more complex, the image analyzing unit may increase a reduced luminance amount of the boundary luminance variable area based on an edge map of the image.

The luminance processing unit may reduce a luminance of the boundary luminance variable area based on the reduced luminance amount determined from the image analyzing unit.

The luminance processing unit may reduce a luminance of the boundary luminance variable area by gradation and a reduced luminance amount of an area of the boundary luminance variable area adjacent to the letterbox area is the largest and a reduced luminance amount of an area farthest from the letterbox area is the smallest.

The boundary luminance variable area may occupy 10% of a horizontal resolution or 10% of a vertical resolution of the display panel.

It will be apparent to those skilled in the art that various modifications and variations can be made in the display device of the present disclosure without departing from the technical idea or scope of the disclosure. Thus, it is intended that the present disclosure cover the modifications and variations of this disclosure provided they come within the scope of the appended claims and their equivalents.

What is claimed is:

1. A display device, comprising:

a display panel configured to include a letterbox area and an image display area, the image display area configured to display an image and includes a boundary luminance variable area adjacent to the letterbox area; and a luminance controller configured to control a reduced luminance amount of the boundary luminance variable area based on the image, wherein the luminance controller is configured to analyze an edge map for an image which is displayed in the boundary luminance variable area to increase the reduced luminance amount of the boundary luminance variable area when a number of sub pixels corresponding to an edge, among a plurality of sub pixels of the boundary luminance variable area, is larger than a reference number.

2. The display device according to claim 1, wherein when a number of sub pixels corresponding to the edge, among the plurality of sub pixels of the boundary luminance variable area, is smaller than the reference number, the luminance controller is configured to reduce the reduced luminance amount of the boundary luminance variable area.

3. The display device according to claim 1, wherein the luminance controller is configured to analyze a motion map for an image which is displayed in the boundary luminance variable area to reduce the reduced luminance amount of the boundary luminance variable area when a number of sub pixels corresponding to a motion, among a plurality of sub pixels of the boundary luminance variable area, is smaller than the reference number.

4. The display device according to claim 3, wherein when the number of sub pixels corresponding to the motion, among the plurality of sub pixels of the boundary luminance variable area, is larger than the reference number, the luminance control controller is configured to increase the reduced luminance amount of the boundary luminance variable area.

5. The display device according to claim 1, wherein the luminance controller is configured to gradually increase a luminance of the boundary luminance variable area along a direction directed to the inside of the image display area from the letterbox area.

6. A display device, comprising:

a display panel configured to include a letterbox area and an image display area disposed at one side of the letterbox area to display an image; and a luminance controller configured to analyze an image to reduce a luminance of a boundary luminance variable area of the image display area adjacent to the letterbox area, wherein, when a dynamic image is displayed, the luminance controller is configured to reduce the luminance of the boundary luminance variable area as compared to the luminance of the boundary luminance variable area when a static image is displayed.

7. The display device according to claim 6, wherein the luminance controller includes:

a letterbox detector configured to detect the letterbox area;

an image analyzer configured to analyze a part of an image corresponding to the boundary luminance variable area; and a luminance processor configured to control a reduced luminance amount of the boundary luminance variable area based on an analysis result of the image analyzer.

8. The display device according to claim 7, wherein the letterbox detector is configured to detect an effective line including a sub pixel which displays an image, among a plurality of sub pixels of the display panel and defines positions of the letterbox area and the image display area based on the effective line.

9. The display device according to claim 7, wherein as the image is more dynamic, the image analyzer is configured to increase the reduced luminance amount of the boundary luminance variable area based on a motion map of the image and as the image is more complex, the image analyzer being configured to increase the reduced luminance amount of the boundary luminance variable area based on an edge map of the image.

10. The display device according to claim 9, wherein the luminance processor is configured to reduce the luminance of the boundary luminance variable area based on the reduced luminance amount determined from the image analyzer.

11. The display device according to claim 10, wherein the luminance processor is configured to reduce the luminance of the boundary luminance variable area by gradation and the reduced luminance amount of an area of the boundary luminance variable area adjacent to the letterbox area is the largest and a reduced luminance amount of an area farthest from the letterbox area is the smallest.

12. The display device according to claim 6, wherein the boundary luminance variable area occupies 10% of a horizontal resolution or 10% of a vertical resolution of the display panel.

13. A display device, comprising:

a display panel configured to include a letterbox area and an image display area, the image display area configured to display an image and includes a boundary luminance variable area adjacent to the letterbox area; and a luminance controller configured to control a reduced luminance amount of the boundary luminance variable area based on the image, wherein the luminance controller is configured to analyze a motion map for an image which is displayed in the boundary luminance variable area to reduce the reduced luminance amount of the boundary luminance variable area when a number of sub pixels corresponding to a motion, among a plurality of sub pixels of the boundary luminance variable area, is smaller than a reference number.

14. The display device according to claim 13, wherein when the number of sub pixels corresponding to the motion, among the plurality of sub pixels of the boundary luminance variable area, is larger than the reference number, the luminance controller is configured to increase the reduced luminance amount of the boundary luminance variable area.

* * * * *